United States Patent [19]

Lau

[11] Patent Number: 5,048,263

[45] Date of Patent: Sep. 17, 1991

[54] PROCESS AND APPARATUS FOR FOLDING SOCK CUFFS

[75] Inventor: David Lau, Templestowe, Australia

[73] Assignee: Pacific Dunlop Limited, Victoria, Australia

[21] Appl. No.: 466,273

[22] PCT Filed: Aug. 22, 1988

[86] PCT No.: PCT/AU88/00315

§ 371 Date: Apr. 20, 1990

§ 102(e) Date: Apr. 20, 1990

[87] PCT Pub. No.: WO89/01439

PCT Pub. Date: Feb. 23, 1989

[30] Foreign Application Priority Data

Aug. 21, 1987 [AU] Australia ..... PI 3885

[51] Int. Cl.[5] ..... B65B 25/20; B65B 63/04

[52] U.S. Cl. ..... 53/429; 53/117; 223/1

[58] Field of Search ..... 53/429, 117, 116; 223/38, 37, 1

[56] References Cited

U.S. PATENT DOCUMENTS

| | | | |
|---|---|---|---|
| 2,773,340 | 12/1956 | McCarthy | 53/429 |
| 2,849,167 | 8/1958 | Walser, Jr. | 223/1 X |
| 2,925,693 | 2/1960 | Boone | 223/1 X |
| 2,989,178 | 6/1961 | Parker, Jr. | 53/117 X |
| 3,097,770 | 7/1963 | Garrou | 53/117 X |
| 4,827,693 | 5/1989 | Egea et al. | 53/429 X |
| 4,922,685 | 5/1990 | Hodges | 53/429 |

*Primary Examiner*—James F. Coan

*Attorney, Agent, or Firm*—Fred Philpitt

[57] ABSTRACT

An apparatus and process for folding a sock cuff, which comprises a blade mounted on and projecting from a support, a first carriage mounted for reciprocal movement along and over said blade and having first gripping means adapted to space and grip the open end of a sock such that movement of the carriage along the blade will substantially envelop the blade with the sock, a second carriage mounted for reciprocal movement along said blade and having second gripping means adapted to move transversely to the blade to grip the sock covering said blade, and means for actuating (i) said carriage to reciprocally move said carriage along said blade, (ii) said first gripping means to grip and release the open end of said sock and, (iii) said second gripping means to reciprocally move said means along the blade and transversely thereto. A process of folding a sock cuff, more particularly, a 'walk' sock cuff, is also provided.

14 Claims, 5 Drawing Sheets

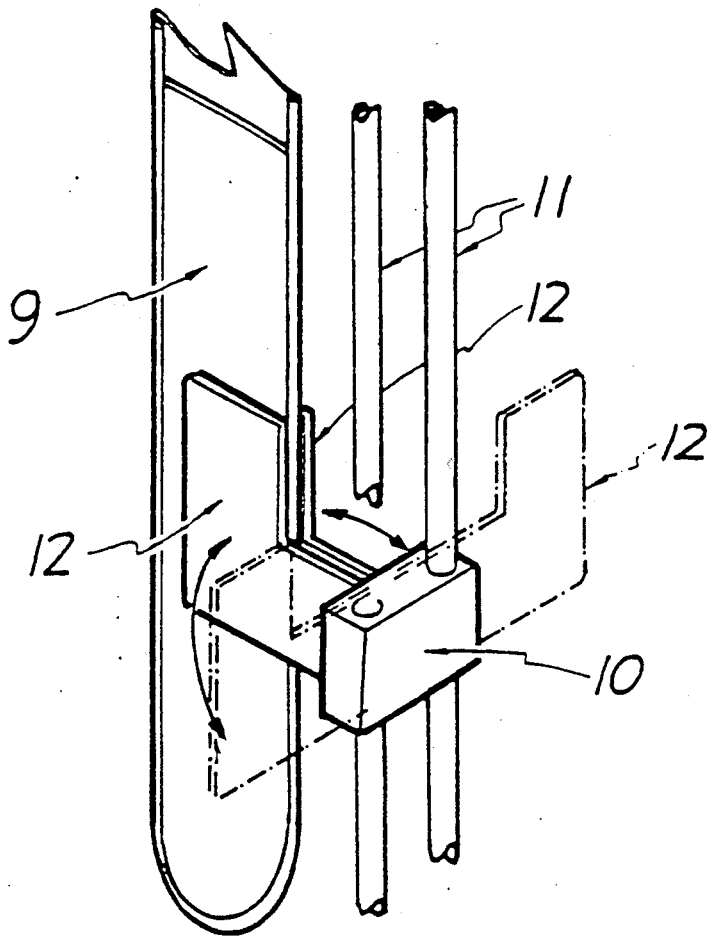
FIGURE.1
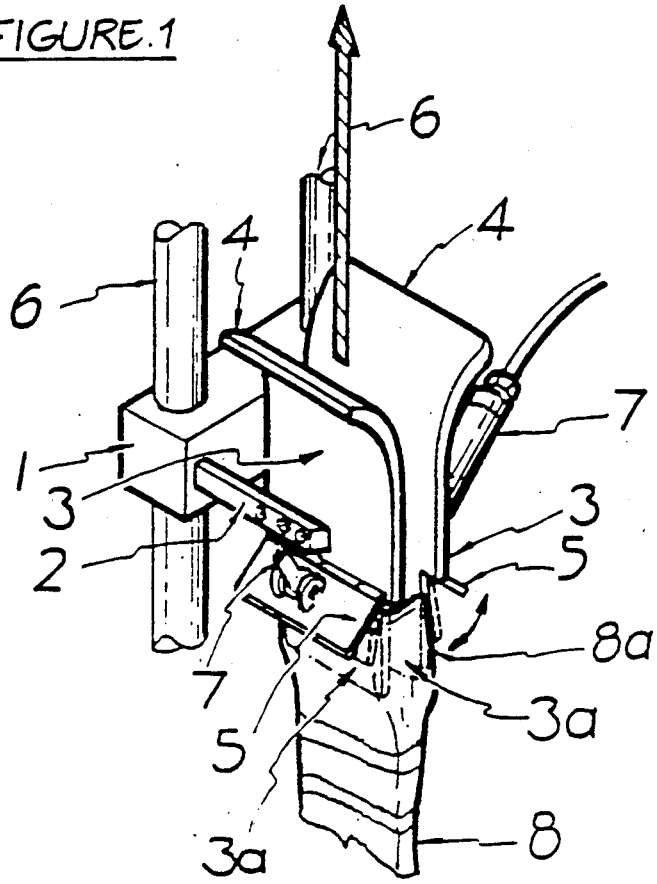

A
50
50a
31
32
52
X
53
51
9a
9b
9
8
10
11
40
30
12
4
5
7
2
1
6
70

PROCESS AND APPARATUS FOR FOLDING SOCK CUFFS

This invention relates to a process and apparatus for folding sock cuffs; more particularly, the cuffs of "walk" socks; that is, knee length socks which are folded over in use just below the knee.

Socks, particularly of the type described above, are desirably packaged and sold with a cardboard insert therein and with the cuff folded over (often displaying a coloured pattern or design in that configuration), this producing a satisfactory visual presentation from a marketing point of view.

Heretofore, the above packaging and, more particularly, the folding of the sock cuff was effected manually which is time consuming and can lead to repetitive strain injury (RSI) of the operator's arms and wrists.

Accordingly, it is the principal objective of this invention to provide a process and apparatus for mechanically folding a sock cuff, preferably, a "walk" sock cuff.

It is a further objective to provide such a process includes means to incorporate a and apparatus which includes means to incorporate a cardboard insert inside the sock.

It is yet another objective of the invention to provide such a process and apparatus which includes means for the continuous production of socks in the above configuration using mechanisms under electronically programmable control.

According to one aspect of the present invention, there is provided a process of folding a sock cuff, more particularly, a "walk" sock cuff, comprising (a) locating and gripping the open end of a sock on a carriage mounted for reciprocal movement over and along a blade, (b) moving said carriage over and along said blade so that a substantial portion of said sock covers the blade, (c) gripping said sock adjacent but below the fold line location of said sock cuff, (d) tensioning the portion below said fold line by moving the gripped area of said sock axially along the blade away from the free end thereof, (e) releasing the grip on said open end of said sock, (f) folding said sock cuff over the gripped area of said sock, and (g) releasing and removing grip on said fold line adjacent portion.

Advantageously, the gripping of said fold line adjacent portion is momentarily relaxed prior to the folding of the cuff in order to avoid aggregation of material and mishandling during the folding of the cuff The above has the effect of slightly relaxing the sock so as to also allow predictability in the length of the folded cuff.

According to a preferred aspect of the above process, the blade is loaded with a cardboard member of suitable dimensions to fit the inside of the sock prior to the commencement of said process. This may be conveniently effected by mechanically, preferably with the aid of suction means, transferring the cardboard member from a storage area (containing a stack of cardboard members) to the blade.

According to a further preferred aspect of the invention, the blade with the folded sock (optionally with the cardboard member in the blade) is then transported to another location where the sock is stripped from the blade.

According to another aspect of the invention, there is provided apparatus for folding a sock cuff, preferably a "walk" sock cuff, comprising (a) a blade mounted on and projecting from a support, (b) a first carriage mounted for reciprocal movement along and over said blade and having first gripping means adapted to space and grip the open end of a sock such that movement of the carriage along the blade will substantially envelop the blade with the sock, (c) a second carriage mounted for reciprocal movement along said blade and having second gripping means adapted to move transversly to the blade to grip the sock covering said blade, (d) means for actuating (i) said first carriage to reciprocally move said first carriage along said blade, (ii) said first gripping means to grip and release the open end of said sock, and (iii) said second gripping means to reciprocally move said second gripping means along the blade and transversely thereto.

Advantageously, the apparatus includes means for transferring a cardboard member from a stack of cardboard members to the blade. This may conveniently be effected by means of a pivotally mounted arm associated with suction means adapted to engage and suctionally remove a cardboard member from said stack and to locate said member on the blade to be retained thereon.

For the above purpose, one side of said blade is conveniently provided with a pair of opposed channel shaped ribs, preferably also with a leaf spring to assist retention of the cardboard member in the blade.

Conveniently, the first carriage includes a pair of spaced blades on which the open end of the sock is located so as to distend said end, and a pair of flaps pivotally connected to said blades to grip said open end of the sock in the closed position.

Conveniently, the second gripping means may take the form of a pair of pivotally mounted plates having a duck-bill like action. Preferably, each plate is provided with a high friction surface strip.

The apparatus may also include, at a separate location sock stripping means for gripping and stripping the sock from the blade. The above may conveniently comprise a third carriage mounted for reciprocal movement along the blade carrying the folded sock and a pair of jaws mounted on said third carriage adapted for reciprocal movement in a transverse direction.

According to a further aspect of the invention, the apparatus may conveniently comprise a plurality of blades depending from an endless conveyer carousel, each blade in sequence co-operating with the other components of the cuff folding apparatus described above.

The actuation and control of the various components of the apparatus described above may advantageously be effected by electronically programmable pneumatically, sequentially actuated means, well known per se.

A preferred embodiment of the invention will now be described and illustrated with reference to the accompanying drawings wherein:

FIGS. 1, 2 and 3 are views of the sock cuff folding apparatus, according to this invention, before, during and at the end, respectively, of the sock's travel over the blade;

Figure 2:
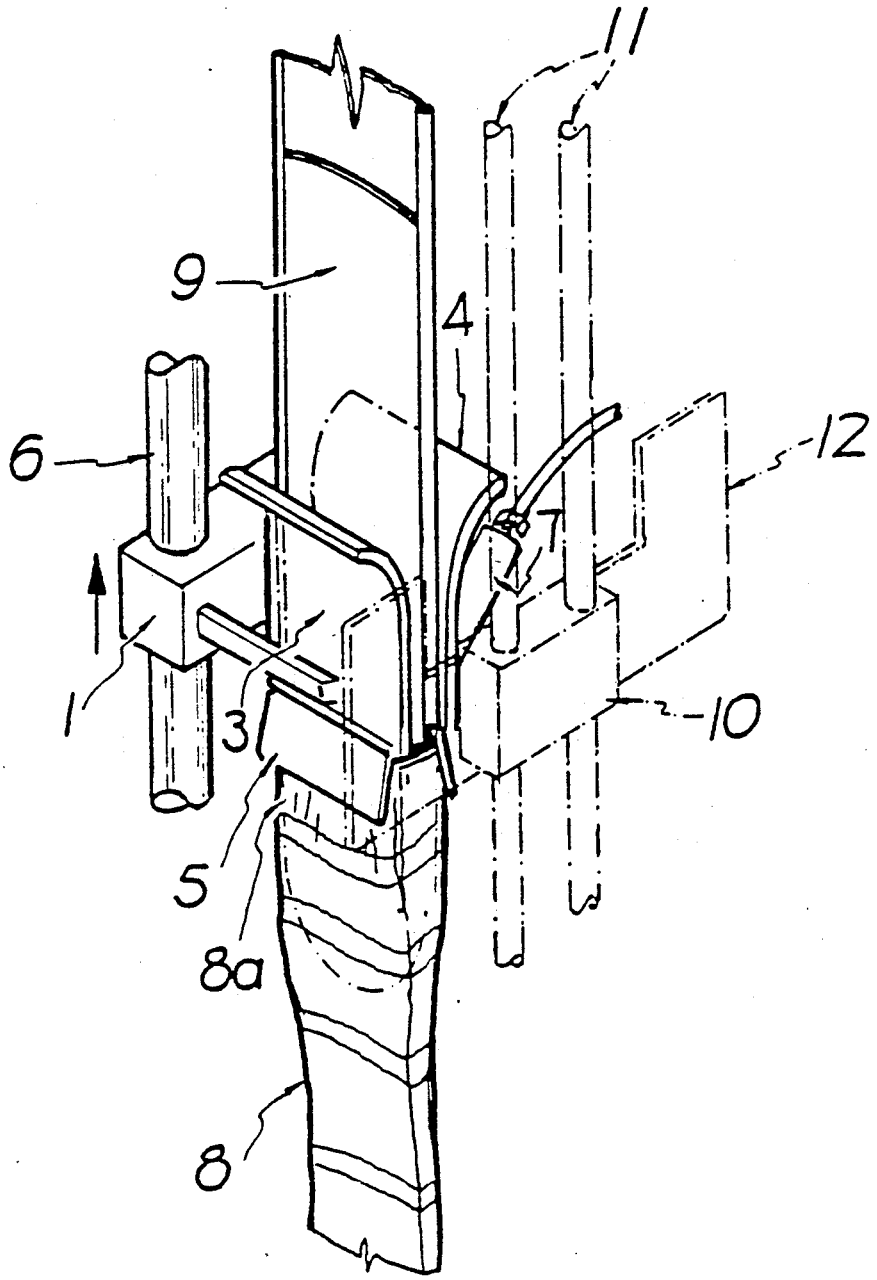
Figure 3:
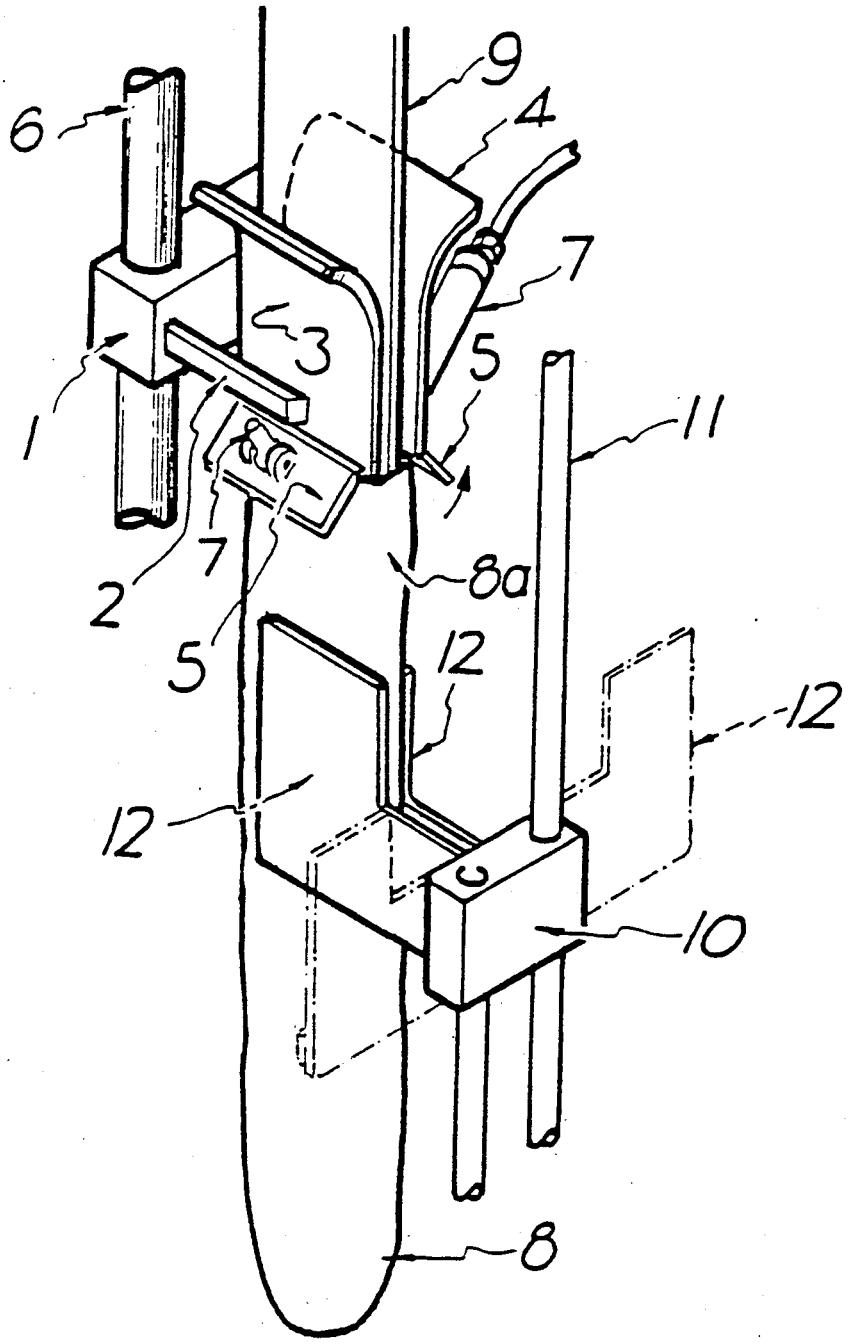
Figure 4:
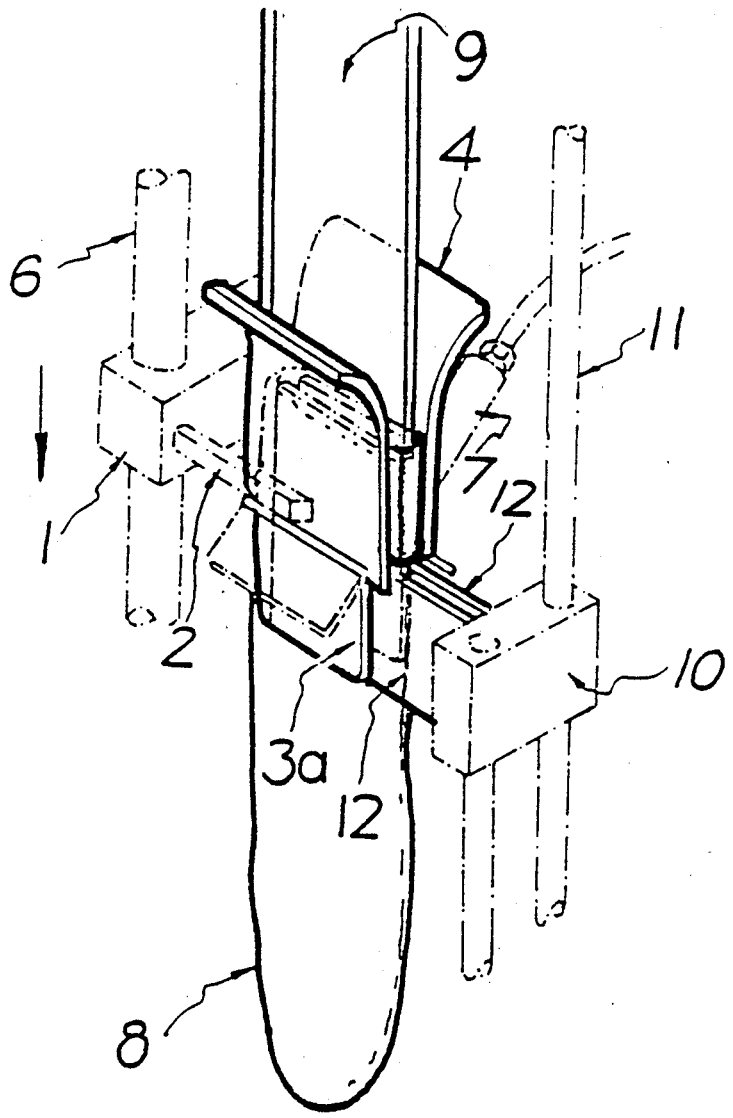
FIG. 4 is a view of the above apparatus after the sock cuff has been folded down.

Referring to FIGS. 1 to 4, the apparatus for folding a sock cuff comprises a carriage 1 mounted on a pair of rods 6 for reciprocal movement in a vertical direction. Attached to said carriage, by a pair of arms 2 are a pair of spaced plates 3 with flanges 4. A pair of flaps 5 are pivotally connected to plates 3. Flaps 5 are actuated for angular movement by pneumatic connection 7. The lower ends 3*a* of plates 3 are loaded with the open end 8*a* of a sock 8.

Figure 5:
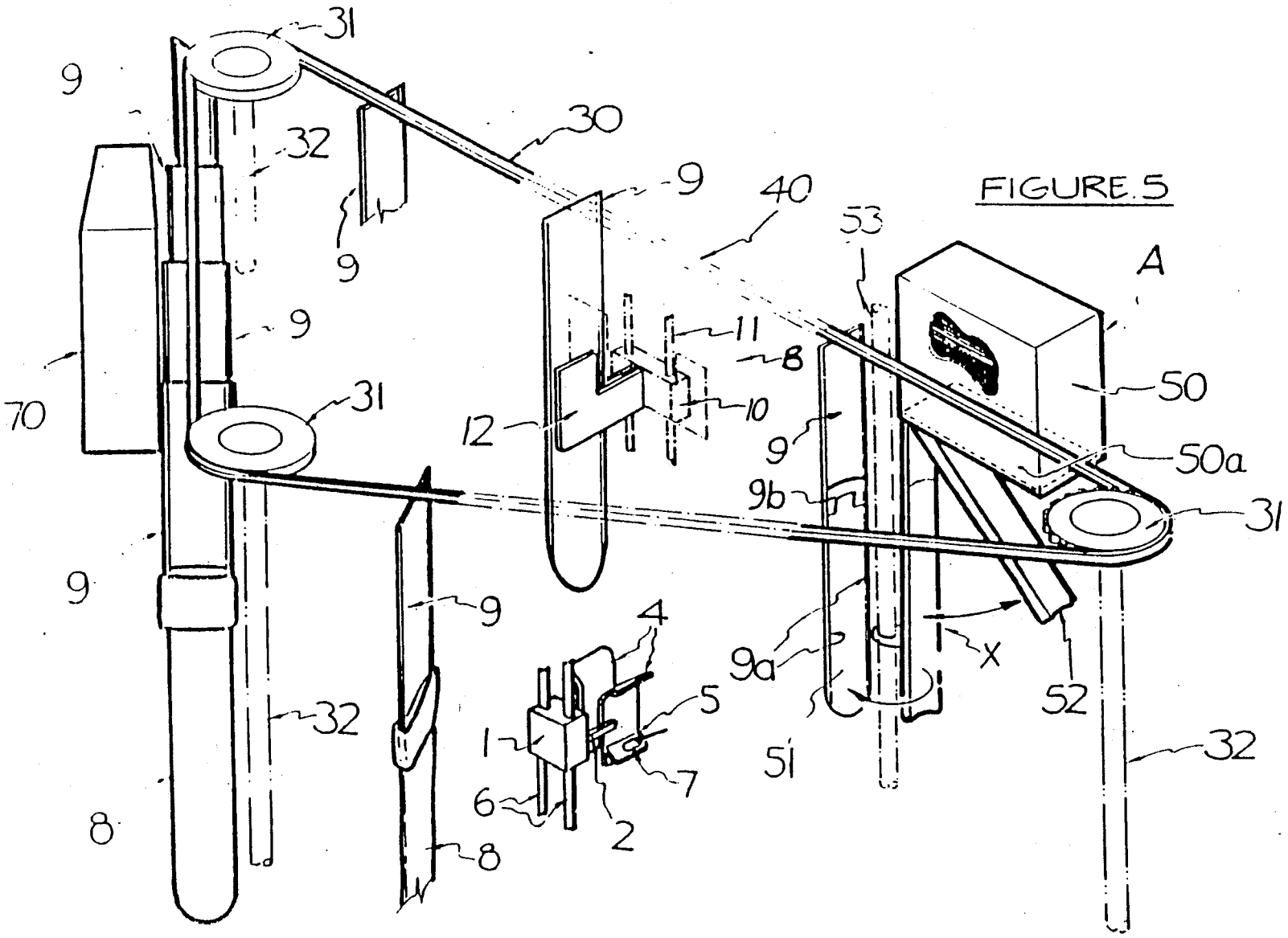
FIG. 5 is a view of a conveyor (carousel) arrangement showing (i) apparatus for the loading of the blades with the cardboard members (station A), and (ii) the apparatus shown in FIGS. 1 to 4 above.

Located above said spaced plates 3 and substantially in alignment with the space therebetween is a blade 9 mounted on a chain 30 (cf. FIG. 5).

A further carriage 10 mounted on rods 11 for reciprocal movement in a vertical direction has a pair of plates 12 pivotally connected thereto for angular horizontal movement in a 90° arc. Plates 12 are advantageously provided with strips of high friction material (friction in upwards direction only) and are also actuated for movement by suitable pneumatic means (not shown).

Referring to FIG. 5, an endless conveyer (carousel), generally indicated as 40, comprises a chain 30 driven by toothed wheels 31 mounted on drive rods 32.

Dependant from said chain 30 are a plurality of spaced blades 9 each of which is adapted to co-operate sequentially with the apparatus shown in FIGS. 1 to 4 above (station B).

Station A comprises a magazine 50 supporting a stack of cardboard members 51 and having a elongated opening 50*a* extending along its bottom exposing a substantial portion of the lower most cardboard member 51.

Delivery arm 52 connected to suction means (not shown) is pivotally connected to an upright rod 53 mounted for rotation about its axis, so as to align itself, in the pick up position, with the opening 50*a* and, in the delivery position, with one side of the blade 9 which is provided with a pair of opposed channel shaped rims 9*a* extending along its length and a leaf spring 9*b* intermediate its length. Thus, delivery arm 52 when aligned with opening 50*a* of magazine 50 extracts the lower most cardboard member 51 with the aid of the suction device associated with arm 52. Arm 52 then pivotally moves to position X where it is rotated through 180° and inserts cardboard member 51 into the channel shaped rims 9*a* of blade 9 where it is firmly retained with the aid of leaf spring 9*b*.

Also included in the carousel arrangement, is a stripping apparatus (not shown) comprised of a carriage mounted on a pair rods for movement in a vertical direction and a pair of jaws mounted on said carriage which jaws are provided with fingers which have the function of engaging the sock 8 and cardboard member 51 and stripping these from the blade 9. The jaws are mounted on the carriage so that they are capable of reciprocal movement in a transverse direction relative to the blade 9.

Having passed the stripping apparatus, the blade then passes an inspection station (not shown) which ensures that each blade leaving said inspection station, is no longer loaded with a sock. Having passed the inspection station, the stripped blade 9 proceeds to station A for loading with cardboard member 51 in the manner described above.

As already mentioned, a movements of the various components of the above apparatus are effected by electronically programmable, pneumatically, sequentially actuated means. The controls for the above means are located in computer module 70.

In practice, the invention is carried out as follows:

At the start of the cycle (this portion represents about 6 seconds; 4 seconds optimum) (cf. FIG. 1), the open end 8*a* of sock 8 is "loaded" onto the lower ends 3*a* of plates 3. (The machine allows up to 3 seconds for this to be done; as this is done by hand, there are numerous safety mechanisms to safeguard against the machine starting off with an operator's hand in the vicinity). Plates 12 clamp onto blade 9 to steady and align the blade vis a vis the space between the flanged ends 4 of plates 3. Flaps 5 then close clamping the open end (cuff) of the sock to said lower ends 3*a* of plates 3. At this point, plates 12 open and carriage 1 (and plates 3) commences its upward travel as a result of a signal received when the flaps 5 close (FIG. 2). During the upward travel of carriage 1 (and plates 3), flaps 5 remain clamped thus allowing the sock to be hauled up over blade 9 which is carrying cardboard member 51 inserted in the previous station (station A). When carriage 1 (and plates 3) reaches the top of its stroke (FIG. 3), plates 12 clamp and haul the top section of sock 8 fully upwards which removes any slack. Plates 12 are then momentarily released effecting a relaxation of the top end of sock S With all of sock 8 under tension, plates 12 reclamp sock 8 and flaps 5 release. Carriage 1 then moves downwards and plates 3 fold the cuff 8*a* of sock 8 over the top edges of plates 12 (if plates 12 were not momentarily released, cuff 8*a* would invariably be too long to allow trouble free release of plate 12 i.e. they could vary well jam up).

Carriage 1 (and plates 3) continues its downwards movement until it clears the bottom edge of blade 9 at which time the indexing of this phase commences. Plates I are released and withdraw downwardly from under the now folded 10 cuff The next sock is loaded onto the ends 3*a* of blades 3. Plates 12 are opened and then clamp onto the next blade 9 which has moved into the commencement position, steadying said blade 9, and the next cycle continues.

Eventually, after travelling around carousel 30 and after several inspection points (not shown), folded sock 8 together with its cardboard reinforcement member 51 arrive at the stripping apparatus, already discussed, which clamps the top of the cuff and cardboard member 51 sliding the entire assembly off the blade and into a chute which leads to the next step in packaging.

I claim:

1. A process of folding a sock cuff comprising (a) locating and gripping the open end of a sock on a carriage mounted for reciprocal movement over and along a blade, (b) moving said carriage over and along said blade so that a substantial portion of said sock covers the blade, (c) gripping said sock adjacent but below the fold line location of said sock cuff, (d) tensioning the portion below said fold line by moving the gripped area of said sock axially along the blade away from the free end thereof, (e) releasing the grip on said open end of said sock, (f) folding said sock cuff over the gripped area of said sock, and (g) releasing and removing grip on said fold line adjacent portion.

2. A process as claimed in claim 1, wherein the gripping of said fold line adjacent portion is momentarily relaxed prior to the folding of the cuff.

3. A process as claimed in claim 1 further comprising loading the blade with a cardboard member of suitable dimensions to fit the inside of the sock prior to the commencement of said process.

4. A process as claimed in claim 3, wherein the blade is loaded by mechanically, transferring the cardboard member from a storage area (containing a stack of cardboard members) to the blade.

5. A process as claimed in claim 1, wherein the blade with the folded sock is then transported to another location where the sock is stripped from the blade.

6. Apparatus for folding a sock cuff comprising (a) a blade mounted on and projecting from a support, (b) a first carriage mounted for reciprocal movement along and over said blade and having first gripping means adapted to space and grip the open end of a sock such that movement of the carriage along the blade will substantially envelop the blade with the sock, (c) a second carriage mounted for reciprocal movement along said blade and having second gripping means adapted to move transversly to the blade to grip the sock covering said blade, (d) means for actuating (i) said first carriage to reciprocally move said first carriage along said blade, (ii) said first gripping means to grip and release the open end of said sock and (iii) said second gripping means to reciprocally move said second gripping means along the blade and transversely thereto.

7. Apparatus as claimed in claim 6 including means for transferring a cardboard member from a stack of cardboard members to the blade.

8. Apparats as claimed in claim 7, wherein said transferring means comprises a pivotally mounted arm associated with suction means adapted to engage and suctionally remove a cardboard member from said stack and to locate said member on the blade to be retained thereon.

9. Apparatus as claimed in claim 8, wherein one side of said blade is provided with a pair of opposed channel shaped rims, to assist retention of the cardboard member in the blade.

10. Apparatus as claimed in claim 6, wherein the first carriage includes a pair of spaced blades on which the open end of the sock is located so as to distend said end, and a pair of flaps pivotally connected to said blades to grip said open end of the sock in the closed position.

11. Apparatus as claimed in claim 6, wherein the second gripping means takes the form of a pair of pivotally mounted plates having duck-bill like action, each plate being provided preferably with a high friction surface strip.

12. Apparatus as set forth in claim 6, also including, at a separate location, sock stripping means for gripping and stripping the sock from the blade.

13. Apparatus as claimed in claim 15, wherein said sock stripping means comprises a third carriage mounted for reciprocal movement along the blade carrying the folded sock and a pair of jaws mounted on said third carriage adapted for reciprocal movement in a transverse direction.

14. Apparatus for folding a sock cuff comprising a plurality of blades depending from an endless conveyer carousel, each blade in sequence co-operating with the other components of the cuff folding apparatus in claim 6.

* * * * *